US008640715B2

(12) United States Patent
Howell

(10) Patent No.: US 8,640,715 B2
(45) Date of Patent: Feb. 4, 2014

(54) NAIL CARE DEVICE

(76) Inventor: David B. Howell, Woodland Hills, CA (US)

( * ) Notice: Subject to any disclaimer, the term of this patent is extended or adjusted under 35 U.S.C. 154(b) by 0 days.

(21) Appl. No.: 13/083,124

(22) Filed: Apr. 8, 2011

(65) Prior Publication Data

US 2012/0255570 A1 Oct. 11, 2012

(51) Int. Cl.
*A45D 29/05* (2006.01)

(52) U.S. Cl.
USPC ..... 132/73.6

(58) Field of Classification Search
USPC ..... 132/75.3–75.6, 75.8, 76.2, 76.4, 76.5; 74/25; 29/76.4; 433/118; 30/277.4, 30/142, 26
See application file for complete search history.

(56) References Cited

U.S. PATENT DOCUMENTS

| | | | | | |
|---|---|---|---|---|---|
| 2,056,379 | A * | 10/1936 | Acocella | 132/73.6 |
| 2,239,870 | A * | 4/1941 | Ariza | 132/73.6 |
| 2,880,737 | A * | 4/1959 | Tone et al. | 132/73.6 |
| 3,240,966 | A * | 3/1966 | Thompson | 310/50 |
| 3,587,596 | A * | 6/1971 | Wolff | 132/73.6 |
| 4,137,926 | A * | 2/1979 | Pao | 132/73.6 |
| 4,328,819 | A | 5/1982 | Haas | |
| 4,408,623 | A * | 10/1983 | Murray | 132/73.6 |
| 4,478,232 | A * | 10/1984 | Yasuda | 132/73.6 |
| 4,643,207 | A * | 2/1987 | Grahame | 132/73.6 |
| 5,465,740 | A | 11/1995 | Kim | |
| 5,762,077 | A * | 6/1998 | Griffiths, Jr. | 132/74.5 |
| 6,050,270 | A | 4/2000 | Tyshenko, Jr. | |
| 7,188,628 | B2 | 3/2007 | Shubert et al. | |
| 2009/0211590 | A1 * | 8/2009 | Sarway | 132/73.6 |
| 2010/0000557 | A1 | 1/2010 | Keene | |

* cited by examiner

*Primary Examiner* — Robyn Doan
*Assistant Examiner* — Brianne Kalach
(74) *Attorney, Agent, or Firm* — Nelson Mullins Riley & Scarborough, LLP

(57) ABSTRACT

A nail care apparatus is disclosed. In one embodiment, a nail care apparatus comprises a housing, a blade extending from the housing to a distal end, a motor disposed in the housing and operatively driving the blade to reciprocate in two parallel planes, and a power source providing power to the motor. The distal end of the blade may narrow to a peaked distal edge.

11 Claims, 2 Drawing Sheets

NAIL CARE DEVICE

FIELD OF THE INVENTION

The present invention relates generally to a nail care device. More particularly, the present invention relates to a reciprocating nail file with an oscillating under nail cleaner.

BACKGROUND

Professional manicures and pedicures provide a satisfying appearance of fingernails and toenails. The cost and time involved to obtain professional manicures/pedicures, however, may be an impediment to seek a well-manicured appearance. The embodiments shown and described herein provide professional looking results of a manicure/pedicure in a single device without the expense and inconvenience involved with obtaining a professional manicure/pedicure.

SUMMARY

The present invention recognizes and addresses disadvantages of prior art constructions and methods. Embodiments of the present invention provide a device for caring for fingernails and toenails. In one aspect, the present invention provides an apparatus comprising a housing, a first blade extending from the housing to a distal end, a second blade extending from the housing to a generally planar distal end, at least one motor disposed in the housing, and a power source providing power to the at least one motor. In an alternate embodiment, the at least one motor comprises a first motor operatively driving the first blade and a second motor operatively driving the second blade. The power source may be disposed in the housing. The power source may comprise at least one battery.

The distal end of the first blade may narrow to a peaked distal edge. At least one generally planar surface of the distal end of the second blade defines an abrasive surface configured to trim a nail. The at least one motor may operatively drive the first blade to reciprocate simultaneously in two parallel planes. In one embodiment, the at least one motor may operatively drive the second blade to reciprocate in a plane including the at least one generally planar side surface.

In another aspect, the present invention provides an apparatus comprising a housing, a blade extending from the housing to a distal end, a motor disposed in the housing and operatively driving the blade to reciprocate simultaneously in two parallel planes, and a power source providing power to the motor. The distal end of the blade may narrow to a peaked distal edge.

Those skilled in the art will appreciate the scope of the present invention and realize additional aspects thereof after reading the following detailed description of the preferred embodiments in association with the accompanying drawing figures.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
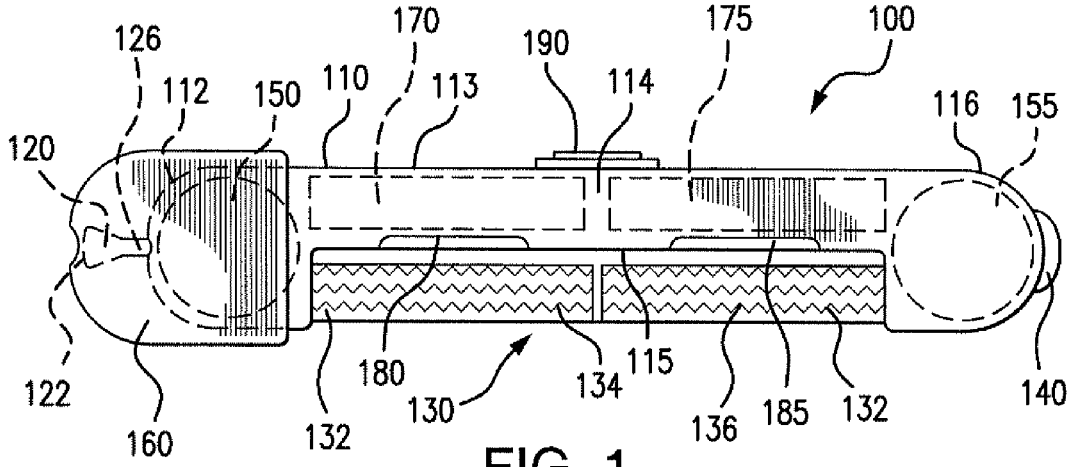
FIG. 1 shows a bottom view of a nail care device according to an embodiment of the present invention.

Repeat use of reference characters in the present specification and drawings is intended to represent same or analogous figures or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
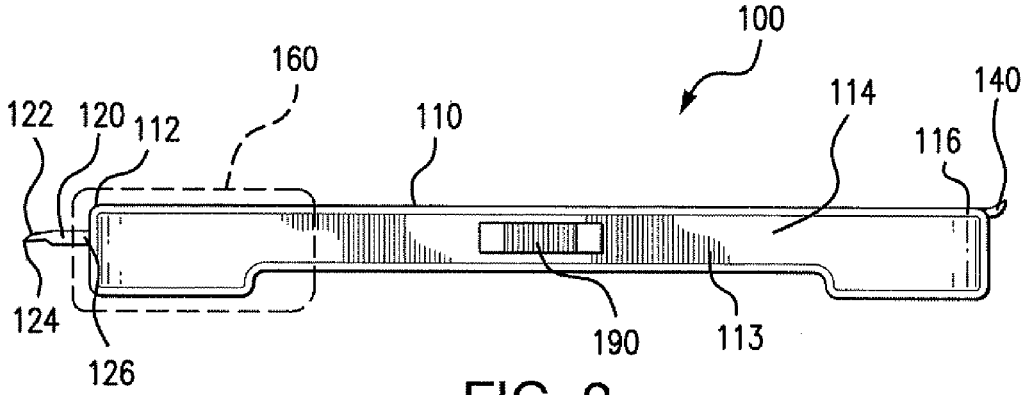
FIG. 2 shows a side view of the nail care device of FIG. 1.
Figure 3:
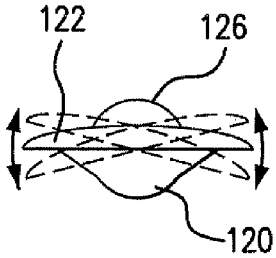
FIG. 3 shows an oscillating pattern of an enlarged view of the under nail cleaning blade of the nail care device of FIG. 1, shown from a front view.

Referring now to FIGS. 1-3, a preferred embodiment of a nail care device 100 in accordance with the present invention is shown. The nail care device 100 may be used to care for fingernails or toenails. The nail care device 100 includes a housing 110 having a first end 112 and a second end 116 disposed opposite the first end 112. The housing 110 may be made of a plastic material. Alternatively, other suitable materials can be used A body 114 is disposed between and joins the first end 112 and the second end 116. The body 114 includes a first wall 113 and a second wall 115 parallel with the first wall 113. From the bottom view shown in FIG. 1 the body 114 of the nail care device is elongate with the first wall 113 parallel with a second blade 130 and semicircular first and second ends 112, 116.

Extending from the first end 112 of the housing 110 is a first blade 120. The first blade 120 may be configured to clean under nails, and may be referred to alternately as an under nail cleaner. The first blade 120 is made of a metallic material suitable for cleaning fingernails and toenails. Other suitable materials can be used. The first blade 120 extends from the first end 112 of the housing 110 to a distal end 122. A proximal end 126 of the first blade 120 may be a cylindrical shaft which flares out (as better seen in FIG. 1) to the distal end 122. As better shown in FIG. 2, the distal end 122 of the first blade 120 narrows to a peaked distal edge 124.

The proximal end 126 of the first blade 120 is fixedly attached to an interior (not shown) of the housing 110. In an alternate embodiment, the first blade 120 may be releasably attached to the housing 110 to facilitate replacement of worn or broken blades. When the first blade 120 is not in use, it may be convenient and desirable to cover the first blade 120. Covering the first blade 120 when not in use can protect the first blade 120 from damage as well as avoiding unintended cuts or scratches.

As shown in FIGS. 1 and 2, a cap 160 is slidably coupled with the first end 112 of the housing 110. In the configuration shown in FIG. 1, the cap 160 completely covers the first blade 120. In the configuration shown in FIG. 2, the cap 160 slides in a direction toward the second end 116 of the housing 110 exposing the first blade 120. To facilitate sliding the cap 160 back and forth, non-slip or non-skid surfaces may be formed on or applied to one or more outer surfaces of the cap 160. Alternatively, the first blade 120 may be configured to retract completely into the interior of the housing 110, thus obviating the need for the cap 160.

Although not shown, the first blade 120 is operatively coupled with a first motor 150. The first motor is disposed within an interior of the housing 110 proximate the first end 112. The first motor 150 is configured to operatively drive the first blade 120 to reciprocate simultaneously in two parallel planes. A variety of suitable motor can be used, such as those motors used in the art, including those in use for known battery-operated nail files. An oscillating pattern of the first blade 120 may be seen in FIG. 3, which shows an enlarged front view of the first blade 120. Other suitable oscillating, waving, or vibrating patterns may be used to clean underneath fingernails or toenails.

The first motor 150 may be powered by a first power source 170. As shown in FIG. 1, the first power source 170 is disposed completely within the interior of the housing 110. The first motor 150 and the first power source 170 are disposed in electrical communication. The first power source 170 may include a battery, such as commonly used and known disposable or rechargeable batteries. Other suitable means of providing electrical power to the first motor 150 can be used.

Referring again to FIGS. 1 and 2, a third blade 140 extends from the second end 116 of the housing 110. As shown in FIG. 1, the third blade 140 is arcuate in shape or crescent-shaped. As shown in FIG. 2, the third blade 140 gradually flares upwardly. The third blade 140 can be used to care for cuticles and may be referred to alternately as a cuticle pusher. The third blade 140 can be formed of a metallic material. Other suitable materials can be used. Unlike the first blade 120, the third blade 140 remains stationary, and thus, does not require a source of power. In an alternate embodiment, the third blade 140 may be retracted into an interior portion of the housing 110 when not in use.

Referring again to FIG. 1, the second blade 130 extends from the housing 110 between the first and second ends 112, 116 of the housing 110. The second blade 130 is disposed proximate to and is parallel with the second wall 115. The second blade 130 extends from the housing 110 to a generally planar distal end 132. At least one generally planar side surface of the distal end 132 defines an abrasive surface 134 configured to trim a nail. The second blade 130 may be referred to alternately as a nail file. A second abrasive surface 136 may be disposed on another portion of the distal end 132 of the second blade 130. The first and second abrasive surfaces 134, 136 may be differing grades, such as course and medium grades. Additional abrasive surfaces may be disposed on opposing sides (not shown) of the second blade 130, and may include fine and finish grades. The second blade 130 may be a metallic nail file. In one embodiment, the second blade 130 may be replaceable or interchangeable with commercially available nail files or emery boards.

Although not shown, the second blade 130 is operatively coupled with a second motor 155. The second motor 155 is disposed within an interior of the housing 110 proximate the second end 116. A variety of suitable motor can be used, such as those motors used in the art, including those in use for known battery-operated nail files. In an alternate embodiment, the first and second blades 120, 130 are powered by a single motor. The placement of first and second motors 150, 155, at opposing ends 112, 116 of the housing 110, as described herein, may provide a balanced feel to the nail care device 100. However, in the embodiment with only a single motor, a balanced feel may be achieved by known methods, such as for example, placing a weighted slug of metal or other material at an opposing end of the device or positioning the motor near the center of the device.

The second motor 155 is configured to operatively drive the second blade 130 to reciprocate between the first and second ends 112, 116 parallel with the second wall 115. The second motor may be powered by a second power source 175. Alternatively, there may be only a single source of power, such as the first power source 170, powering both the first and second motors 150, 155. In the embodiment described herein, the second motor 155 and the second power source 175 are disposed in electrical communication. The second power source 175 may include a battery, such as commonly used and known disposable or rechargeable batteries. Other suitable means of providing electrical power to the second motor 175 can be used. As shown in FIG. 1, the first and second power sources 170, 175 are in the center of the housing 110. The first and second power sources 170, 175 may be placed in other suitable areas of the housing 110.

Still referring to FIG. 1, a first light 180 and a second light 185 are coupled with the second wall 115 proximate to the second blade 130. The first and second lights 180, 185 may be light emitting diodes (LED). Other suitable lighting devices can be used. The first and second lights 180, 185 can be disposed in electrical communication with the second power source 175 and can be powered when the second motor 155 is in operation. Alternatively, the first and second lights 180, 185 can be operated independently of the second blade 130. In one embodiment, a photocell may be positioned within the device such that the first and second lights 180, 185 do not receive electrical power when ambient lighting conditions are sufficient. In this embodiment, there may be an over-ride switch to provide electrical power to the first and second lights 180, 185 regardless of the ambient lighting conditions.

Disposed between the first end 112 and the second end 116 of the housing 110 is a switch 190. In the center position shown, the switch 190 is in the off position. When the switch 190 is moved toward the first end 112, the first blade 120 is in operation. When the switch 190 is moved toward the second end 116, the second blade 130 is in operation. In one embodiment when the switch 190 is depressed against or toward the first wall 113 of the housing 110, the first and second lights 180, 185 may be provided with electrical power regardless of the ambient lighting conditions and regardless of whether the second blade 130 is in operation.

Figures 4, 5, 6:
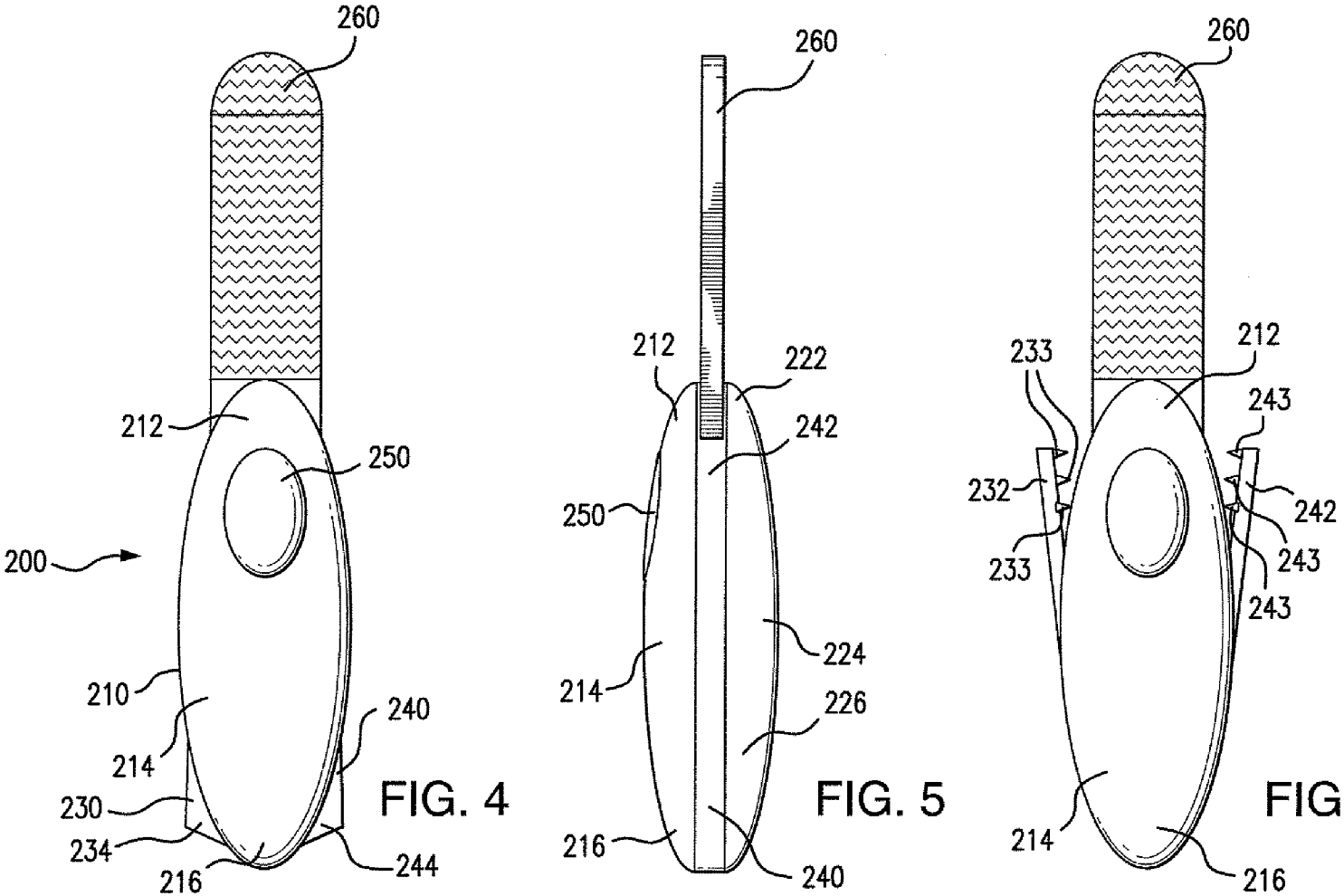
FIG. 4 shows a top view of a nail care device according to an alternate embodiment of the present invention.
FIG. 5 shows a side view of the nail care device of FIG. 4.
FIG. 6 shows the nail care device of FIG. 4 receiving an emery board.

Referring now to FIGS. 4-6, nail care device 200 according to an alternate embodiment of the present invention is shown. The nail care device 200 can be used to care for fingernails or toenails, and can be used to receive interchangeable or disposable commercially available (i.e., off-the-shelf) foam-core emery boards.

The nail care device 200 includes a housing 210. The housing 210 shown is elliptical or egg-shaped. However, other suitable or desired shapes and configurations can be used for the housing 210. The housing 210 can be made of a plastic material. Other suitable materials can be used. The housing 210 includes an upper element 214 and a lower element 224. The upper and lower elements 214, 224 can snap together. Other attachment means can be used.

The upper element 214 includes a first end 212 and a second end 216 disposed opposite the first end 212. The lower element 224 includes a first end 222 and a second end 226 disposed opposite the first end 222. Disposed between the upper element 214 and the lower element 224 is a first jaw 230 and a second jaw 240.

The first jaw 230 includes a first end 232 and a second end 234 disposed opposite the first end 232. The first end 232 of the first jaw 230 is disposed proximate to and between the first ends 212, 222 of the upper and lower elements 214, 224. The second end 234 of the first jaw 230 is disposed proximate to and between the second ends 216, 226 of the upper and lower elements 214, 224. The second end 234 of the first jaw 230 is pivotably coupled with the second ends 216, 226 of the upper and lower elements 214, 224.

The second jaw 240 includes a first end 242 and a second end 244 disposed opposite the first end 242. The first end 242 of the second jaw 240 is disposed proximate to and between the first ends 212, 222 of the upper and lower elements 214, 224. The second end 244 of the second jaw 240 is disposed proximate to and between the second ends 216, 226 of the upper and lower elements 214, 224. The second end 244 of the second jaw 240 is pivotably coupled with the second ends 216, 226 of the upper and lower elements 214, 224.

To receive or remove an emery board 260, the second ends 234, 244 of the first and second jaws 230, 240 are pinched or squeezed together causing the second ends 234, 244 to pivot, and thus open the first ends 232, 242 (as shown in FIG. 6). Once the emery board 260 is in the desired position, the first ends 232, 242 of the first and second jaws 230, 240 are pinched or squeezed together closing the first and second ends 232, 242. The first end 232 of the first jaw 230 includes a plurality of teeth 233. Likewise, the first end 242 of the second jaw 240 includes a plurality of teeth 243. The plurality of teeth 233, 243 are configured to grip or engage the emery board 260. The force with which the teeth 233, 243 grip the emery board 260 is not so strong as to prevent the reciprocating movement of the emery board 260.

Switch 250 can be depressed to actuate a motor (not shown) to cause the emery board to reciprocate in a vertical direction, that is, coaxial with the longitudinal axis formed by the first and second ends 212, 216. A power source (not shown) is provided to power the motor. The motor and the power source are both disposed in an interior (not shown) of the housing 210. To stop the motor, the switch 250 is depressed again. The motor and power source can be similar to those described above. Alternatively, other suitable motors and power sources can be used.

While one or more preferred embodiments of the invention have been described above, it should be understood that any and all equivalent realizations of the present invention are included within the scope and spirit thereof. The embodiments depicted are presented by way of example only and not intended as limitations upon the present invention. Thus, it should be understood by those of ordinary skill in this art that the present invention is not limited to these embodiments as modifications can be made. Therefore, it is contemplated that any and all such embodiments are included in the present invention as may fall within the scope and spirit thereof.

That which is claimed:

1. An apparatus for caring for nails, said apparatus comprising:

a housing having opposed first and second ends and a body extending there between, the body having opposing top and bottom sides;

a first blade extending from an end of the housing, the first blade including a peaked distal end;

a second blade extending along a length of a top surface of the body at a bottom side of the top surface, the second blade including at least one generally planar side surface exposed along its length and defining an abrasive surface configured to trim a fingernail;

at least one motor disposed in the housing and operatively coupled with and driving the first blade to reciprocate and operatively coupled with and driving the second blade to reciprocate in a plane including the planar side surface; and a power source providing power to the at least one motor.

2. The apparatus as in claim 1, wherein the at least one motor comprises a first motor operatively driving the first blade and a second motor operatively driving the second blade.

3. The apparatus as in claim 1, wherein the power source is disposed in the housing.

4. The apparatus as in claim 3, wherein the power source comprises at least one battery.

5. The apparatus as in claim 1, wherein the power source comprises at least one battery disposed in the housing.

6. The apparatus as in claim 1, wherein the second blade reciprocates between the first end and the second end of the housing.

7. An apparatus for caring for nails, said apparatus comprising:

a housing having opposed first and second ends and a body extending there between, the body having opposing top and bottom sides;

first, second and third blades, the first and third blades extending outwardly from the opposed first and second ends of the housing, the first blade including a peaked distal end, the second blade extending along a length of a top surface of the body at a bottom side of the top surface, the second blade including at least one generally planar side surface exposed along its length and defining an abrasive surface configured to trim a fingernail;

at least one motor disposed in the housing at one of the first and second ends and operatively coupled with and driving the first blade to reciprocate, and operatively coupled with and driving the second blade to reciprocate in a plane including the planar side surface; and a power source provided in the top side of the body to provide power to the at least one motor.

8. The apparatus as in claim 7, wherein the at least one motor comprises a first motor operatively driving the first blade and a second motor operatively driving the second blade.

9. The apparatus as in claim 7, wherein the power source is disposed in the housing.

10. The apparatus as in claim 9, wherein the power source comprises at least one battery.

11. An apparatus for caring for nails, said apparatus comprising:

a housing having opposed first and second ends and a body extending there between, the body having opposing top and bottom sides;

first, second and third blades, the first and third blades extending outwardly from the opposed first and second ends of the housing, the first blade including a peaked distal end, the second blade extending along a length of a top surface of the body at a bottom side of the top surface, the second blade including a planar side surface exposed along its length and defining an abrasive surface configured to trim a fingernail;

at least one motor disposed in the housing at one of the first and second ends and operatively coupled with and driving the first blade to reciprocate, and operatively coupled with and driving the second blade to reciprocate in a plane including the planar side surface; and a power source provided in the top side of the body to provide power to the at least one motor.

* * * * *